US011859936B2

(12) United States Patent
Philbin et al.

(10) Patent No.: US 11,859,936 B2
(45) Date of Patent: Jan. 2, 2024

(54) AMMUNITION MAGAZINE AND FOLLOWER CONFIGURED TO CHAMBER AN AMMUNITION CARTRIDGE WITHOUT CONTACTING THE BULLET PORTION OF THE CARTRIDGE

(71) Applicant: Superior Feed Technologies, LLC, Glenview, IL (US)

(72) Inventors: Kevin Philbin, Glenview, IL (US); Scott Richard Gherardini, Hoffman Estates, IL (US); Michael Burke Irwin, Bagdad, KY (US)

(73) Assignee: Superior Feed Technologies, LLC, Glenview, IL (US)

( * ) Notice: Subject to any disclaimer, the term of this patent is extended or adjusted under 35 U.S.C. 154(b) by 0 days.

(21) Appl. No.: 17/149,313

(22) Filed: Jan. 14, 2021

(65) Prior Publication Data

US 2021/0389068 A1 Dec. 16, 2021

Related U.S. Application Data

(60) Provisional application No. 63/059,853, filed on Jul. 31, 2020, provisional application No. 62/984,294, filed on Mar. 2, 2020, provisional application No. 62/961,328, filed on Jan. 15, 2020.

(51) Int. Cl.
*F41A 9/70* (2006.01)
*F41A 17/38* (2006.01)

(52) U.S. Cl.
CPC ..... *F41A 9/70* (2013.01); *F41A 17/38* (2013.01)

(58) Field of Classification Search
CPC ..... F41A 9/66; F41A 9/69; F41A 9/70; F41A 11/00; F41A 9/65; F41A 9/24; F41A 9/25; F41A 9/61; F41A 9/62; F41A 9/00; F41A 15/00; F41A 15/16; F41A 17/00; F41A 17/38
USPC ..... 42/50, 49.01, 7, 49.02, 6
See application file for complete search history.

(56) References Cited

U.S. PATENT DOCUMENTS 4,098,016 A * 7/1978 Foote ..... F41A 21/10 42/16
4,169,329 A * 10/1979 Atchisson ..... F41A 11/02 42/16
4,297,800 A * 11/1981 Atchisson ..... F41A 9/71 42/49.02
4,553,469 A * 11/1985 Atchisson ..... F41A 35/02 42/25
4,619,062 A * 10/1986 Johnson ..... F41A 17/44 42/70.11
4,893,547 A * 1/1990 Atchisson ..... F41A 3/72 89/187.01
2013/0167421 A1* 7/2013 Zheng ..... F41A 9/70 42/50
2014/0366417 A1* 12/2014 Zheng ..... F41A 9/71 42/50

(Continued)

*Primary Examiner* — Michael D David
(74) *Attorney, Agent, or Firm* — Incubate IP; Randy R. Micheletti

(57) ABSTRACT

The present disclosure provides ammunition magazines and followers for use in a firearm, such as an AR15 or M16 firearm, that prevent contact between the bullet portion of a cartridge and interior surfaces of the firearm's receiver portion during transfer of the cartridge from the magazine to the firearm's chamber.

11 Claims, 14 Drawing Sheets

(56) References Cited

U.S. PATENT DOCUMENTS

| | | | | |
|---|---|---|---|---|
| 2015/0121736 | A1* | 5/2015 | Faifer | F16F 1/047<br>42/49.01 |
| 2016/0348992 | A1* | 12/2016 | Tisone | F41A 9/70 |

* cited by examiner

AMMUNITION MAGAZINE AND FOLLOWER CONFIGURED TO CHAMBER AN AMMUNITION CARTRIDGE WITHOUT CONTACTING THE BULLET PORTION OF THE CARTRIDGE

PRIORITY CLAIM

This application claims priority of U.S. Provisional Patent Application Ser. No. 62/961,328 filed Jan. 15, 2020, and entitled "MAGAZINE BOX FOR A FIREARM," U.S. Provisional Patent Application Ser. No. 62/984,294 filed Mar. 2, 2020, and entitled "DOUBLE ROW MAGAZINE BOX FOR A FIREARM," and U.S.

Provisional Patent Application Ser. No. 63/059,853 filed Jul. 31, 2020, and entitled "AMMUNITION MAGAZINE AND FOLLOWER," the entirety of each of which is incorporated herein by reference and relied upon.

BACKGROUND

Firearms, and especially rapid-feed semiautomatic rifles, are prone to cartridge misfeed issues. A firearm's failure to feed can be caused by one or more of dozens of different factors. A need persists for ammunition magazines that conveniently reduce or eliminate cartridge misfeeds.

SUMMARY

The present disclosure provides single stack and double stack ammunition magazines and followers for use with any bottleneck shaped ammunition cartridge, such as a 5.7×30 cartridge, a 0.223 cartridge, or a 5.56 cartridge, and in any firearm, such as an AR15 or M16 firearm.

In some embodiments, the present disclosure provides an ammunition magazine configured to bottom-feed a plurality of ammunition cartridges into an upper receiver of a firearm, the ammunition magazine comprising: a magazine housing including a catch and a floor plate receiver; a spring within the magazine housing; a floor plate retainer disposed at a bottom end of the spring; a floor plate disposed at a bottom end of the magazine housing and reversibly mated with the floor plate retainer; and a magazine follower disposed at a top end of the spring, the magazine follower including: a cartridge-shaped protrusion on a top surface, a ramp on the top surface and disposed adjacent to the cartridge-shaped protrusion, a front leg disposed on a distal end of the magazine follower, and a rear leg disposed generally opposite the front leg.

In other embodiments, the present disclosure provides a magazine follower comprising: a cartridge-shaped protrusion on a top surface, a ramp on the top surface and disposed adjacent to the cartridge-shaped protrusion, a front leg disposed on a distal end of the magazine follower, and a rear leg disposed generally opposite the front leg.

In still other embodiments, the present disclosure provides an ammunition magazine comprising a magazine follower configured to orient all ammunition cartridges housed therewithin at an angle of about 0.2° to about 5° relative to a longitudinal axis of an associated chamber.

In other embodiments, the present disclosure provides a magazine follower configured to orient a first ammunition cartridge housed within an associated ammunition magazine at an angle of about 2° to about 20° relative to a top surface of the magazine follower.

In other embodiments, the present disclosure provides a single stack ammunition magazine comprising: a magazine housing base including: a left-hand feed ramp insert, a left-hand feed lip insert including a plurality of tabs, and a plurality of key seat slotted pockets configured to slidably mate with the tabs of the left-hand feed lip insert; a removable plate including: a right-hand feed ramp insert, a right-hand feed lip insert including a plurality of tabs, has and a plurality of key seat slotted pockets to slidably mate with the tabs of the right-hand feed lip insert; a magazine spring disposed within a magazine housing defined by the magazine housing base and the removable plate; and a magazine follower disposed at a top end of the magazine spring.

In other embodiments, the present disclosure provides a double stack ammunition magazine comprising: a magazine housing base having an integrated left-hand feed ramp insert; a removable magazine box plate having an integrated right-hand feed ramp insert; a magazine spring disposed within a magazine housing defined by the magazine housing base and the removable magazine box plate; and a magazine follower disposed at a top end of the magazine spring.

DETAILED DESCRIPTION

Figure 1:
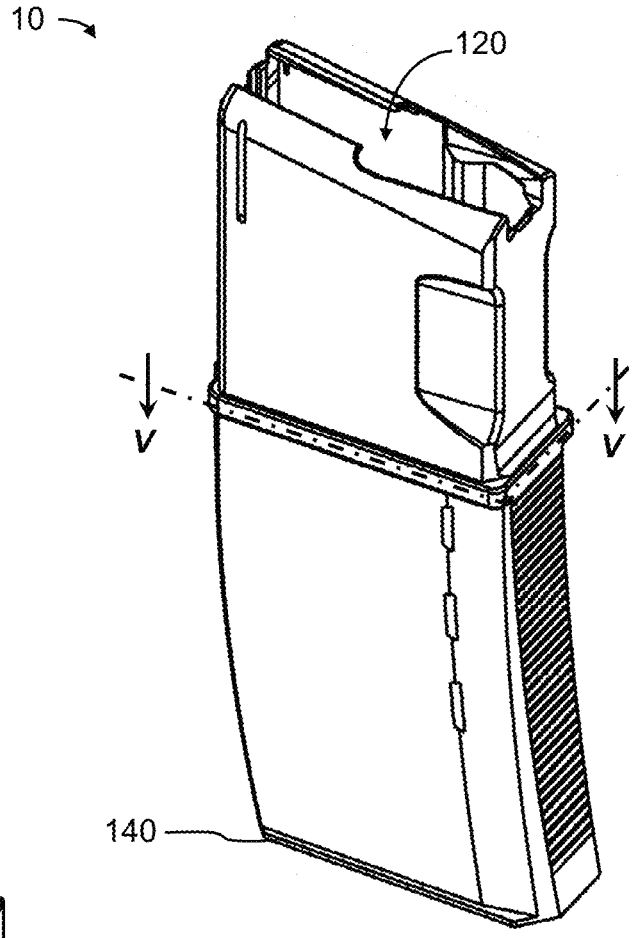
FIG. 1 shows a perspective view of an ammunition magazine housing consistent with one embodiment of the present disclosure.
Figure 2:
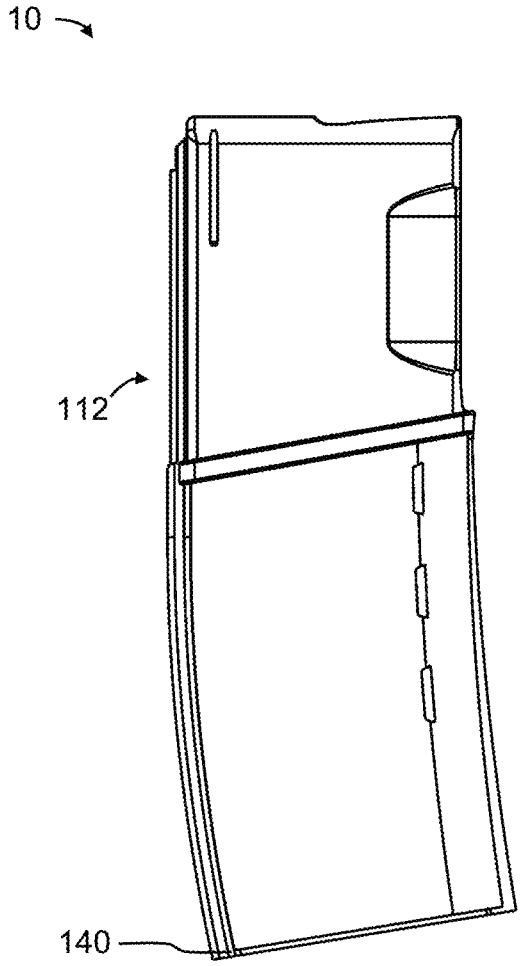
FIG. 2 shows a side plan view of the ammunition magazine of FIG. 1.
Figure 3:
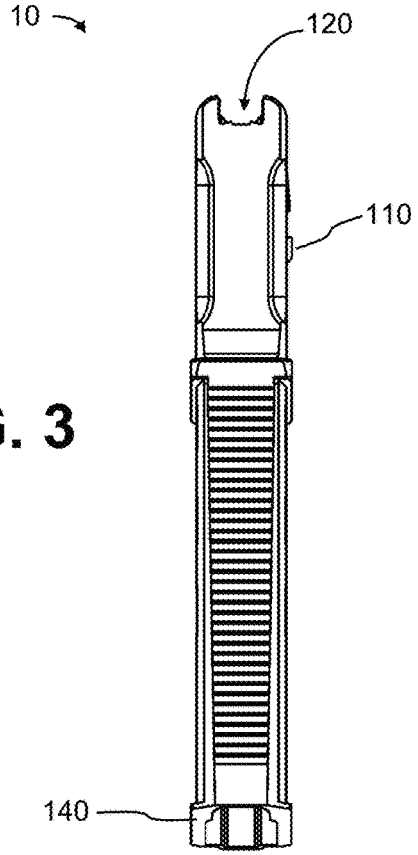
FIG. 3 shows a front plan view of the ammunition magazine of FIG. 1.
Figure 4:
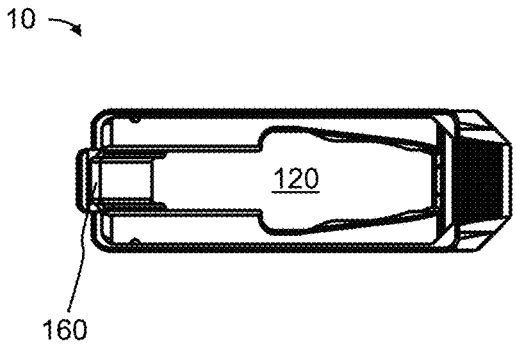
FIG. 4 shows a top plan view of the ammunition magazine of FIG. 1.
Figure 5:
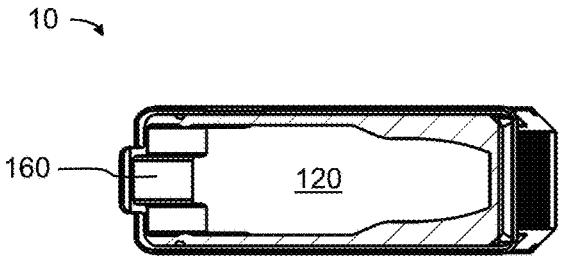
FIG. 5 shows a cross-sectional view of the ammunition magazine of FIG. 1.
Figure 6:
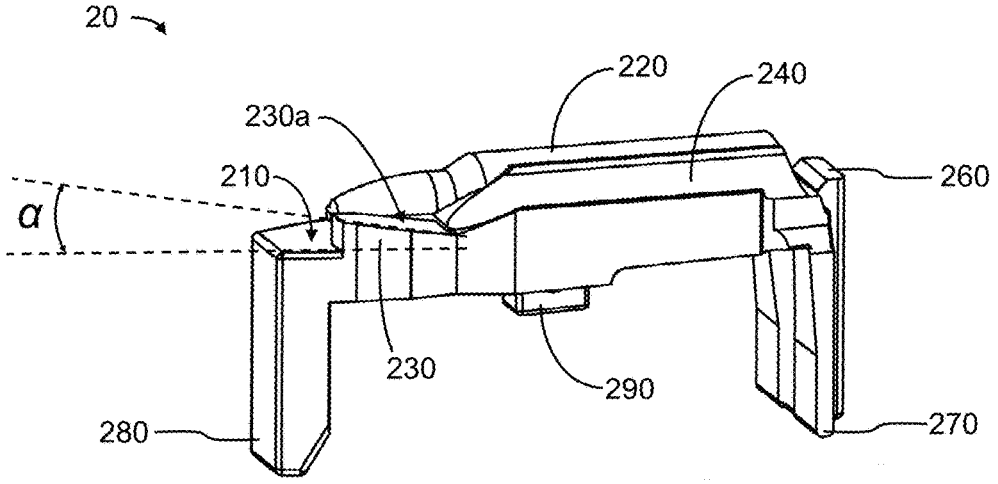
FIG. 6 shows a perspective view of a follower consistent with one embodiment of the present disclosure.
Figure 7:
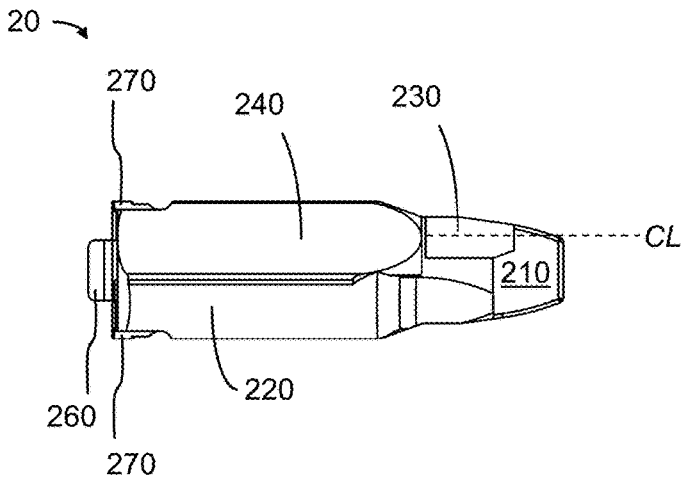
FIG. 7 shows a top plan view of the follower of FIG. 6.
Figure 8:
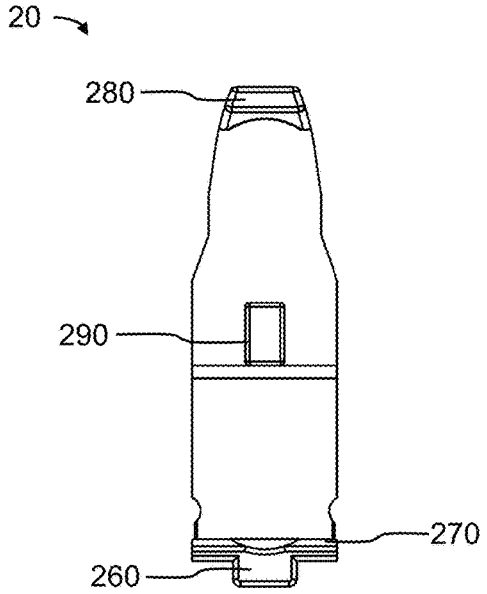
FIG. 8 shows a bottom plan view of the follower of FIG. 6.

In general, the present disclosure provides ammunition magazines and followers that enable feeding ammunition cartridges into a bolt assembly of a firearm without enabling contact between the bullet portion of the cartridge and an interior surface of the receiver portion of the firearm. Use of ammunition magazines and followers consistent with those disclosed herein significantly reduces or even prevents cartridge misfeed errors and the dangers associated therewith.

Referring now specifically to FIGS. 1-10, ammunition magazines consistent with the present disclosure include a magazine housing 10 and a follower 20. The follower 20 is disposed within a cavity 120 of the magazine housing, and is configured to force one or more ammunition cartridges towards the top end of the magazine housing 10 and into an upper receiver of a firearm (not shown).

In some embodiments, the magazine housing 10 includes a catch 110 on its outer face; the catch 110 is configured to selectably mate with the magazine catch of a firearm's lower receiver (not shown) to secure the ammunition magazine to the lower receiver.

The cavity 120 is sized to accommodate two stacked, overlapping columns of ammunition rounds (e.g., a "double-stack" magazine). For example, a magazine housing 10 consistent with the present disclosure may include a cavity 120 sized and shaped to contain a double-stacked arrangement of 0.223 ammunition rounds and/or a double-stacked arrangement of 5.56 ammunition rounds. In another embodiment, the present disclosure may include a cavity 120 sized and shaped for a single nonoverlapping column of ammunition rounds.

In some embodiments, the magazine housing 10 further includes a tail recess 160 extending vertically through the magazine housing 10. The tail recess 160, when present, is disposed near the proximal end 112 of the magazine housing 10, and enables the follower 20 (described in more detail below) travels vertically through the magazine housing 10 smoothly.

The magazine housing 10 further includes a floor plate receiver 140 at the bottom of the magazine housing 10. The floor plate receiver 140 enables the floor plate (not shown) to slidably mate to the bottom of the magazine housing 10.

Referring now to FIGS. 6-10, a follower 20 consistent with the present disclosure and for use with a magazine housing 10 includes a cartridge-shaped protrusion 220, a ramp 230, optionally a front leg 280, and optionally a rear leg 270.

The top surface 210 contacts a first layer of ammunition rounds (not shown) within the cavity 120, and includes a cartridge-shaped protrusion 220 and a ramp 230. In some embodiments, the cartridge-shaped protrusion 220 includes a contour similar to that of an ammunition round, or a portion thereof.

In some embodiments, the top surface of the cartridge-shaped protrusion 220 is disposed at an angle $\beta$ relative to the top surface 210 of the follower 20. In such embodiments, the angle $\beta$ may be about 0.2° to about 5°, for example about 0.2°, about 0.3°, about 0.4°, about 0.5°, about 0.6°, about 0.7°, about 0.8°, about 0.9°, about 1°, about 1.1°, about 1.2°, about 1.3°, about 1.4°, about 1.5°, about 1.6°, about 1.7°, about 1.8°, about 1.9°, about 2°, about 2.1°, about 2.2°, about 2.3°, about 2.4°, about 2.5°, about 2.6°, about 2.7°, about 2.8°, about 2.9°, about 3°, about 3.1°, about 3.2°, about 3.3°, about 3.4°, about 3.5°, about 3.6°, about 3.7°, about 3.8°, about 3.9°, about 4°, about 4.1°, about 4.2°, about 4.3°, about 4.4°, about 4.5°, about 4.6°, about 4.7°, about 4.8°, about 4.9°, or about 5°. In some embodiments, the angle $\beta$ is about 1.2° to about 2°. In some embodiments, the angle $\beta$ is about 1.4° to about 1.8°. In some embodiments, the angle $\beta$ is about 1.5°.

The ramp 230 is disposed near the distal end of the follower 20. The ramp 230 is configured to force the bullet-side tip of an ammunition cartridge upwards and towards the center of the chamber of an upper receiver (not shown) when the ammunition cartridge is advanced out of the magazine housing 10. In some embodiments, the ramp 230 is configured such that the bullet portion of the cartridge does not contact an interior surface of the receiver of the firearm until the bullet portion reaches the barrel of the firearm. The ramp 230 is defined by an attack angle $\alpha$ measured between the surface of the ramp 230 and the surface 210 of the follower 20. The attack angle $\alpha$ may vary depending on the make and model of the firearm, the upper receiver, and/or the cartridge to be used with the ammunition magazine. For example, the attack angle $\alpha$ for a ramp 230 of a follower 20 consistent with the present disclosure for use with a 5.7×30 bottleneck round may be about 11° to about 12°, such as about 11.5°. In another non-limiting example, the attack angle $\alpha$ for the ramp 230 of a follower 20 consistent with the present disclosure for use with a 5.56 caliber cartridge may be about 10° to about 11°, such as about 10.6°. More generally, however, the attack angle $\alpha$ is about 2° to about 20°, for example about 2°, about 3°, about 4°, about 5°, about 6°, about 7°, about 8°, about 9°, about 10°, about 11°, about 12°, about 13°, about 14°, about 15°, about 16°, about 17°, about 18°, about 19°, or about 20°. In some embodiments, the attack angle α is about 11°. In some embodiments, the attack angle α is about 10.6°. In some embodiments, the attack angle α is about 2.5° to about 20°. In some embodiments, the attack angle α is about 10° to about 12°. In some embodiments, the attack angle α is about 16°.

Figure 9A:
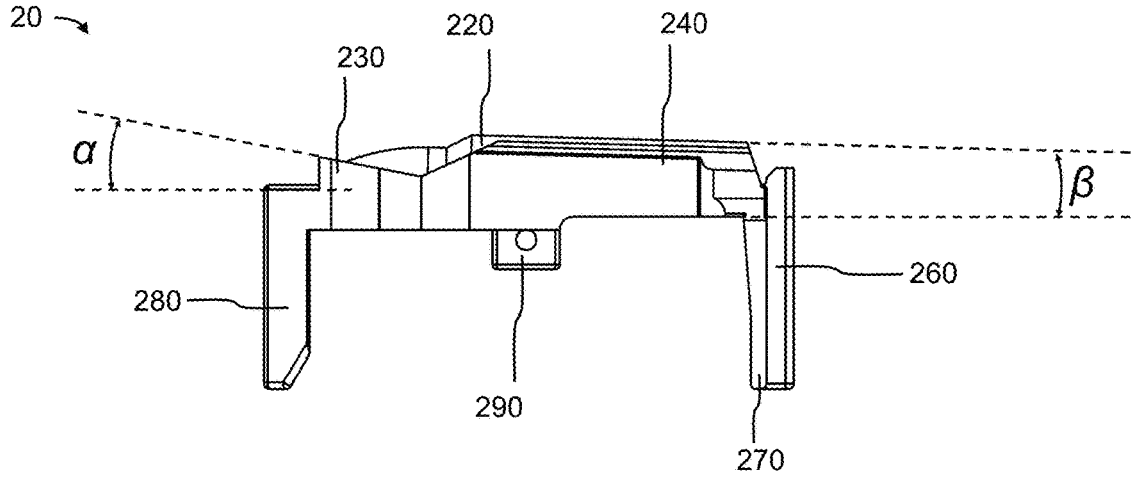
FIG. 9A shows a side plan view of the follower of FIG. 6.
Figure 9B:
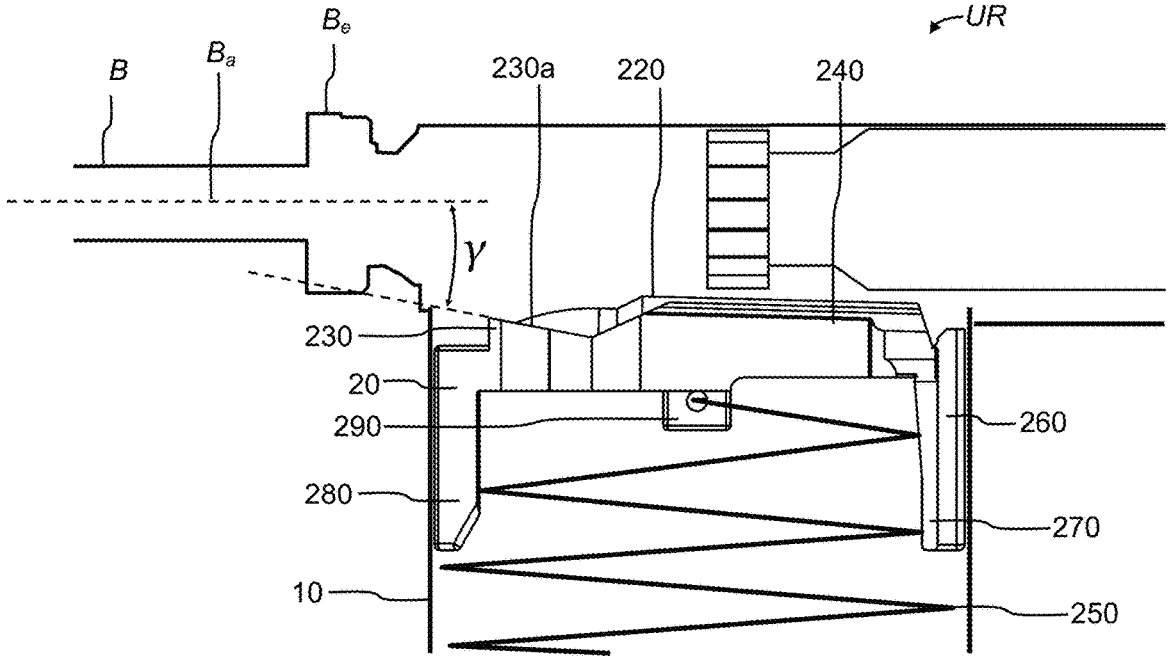
FIG. 9B shows a side plan view of the follower of FIG. 6 relative to an upper receiver of a firearm.
Figure 10:
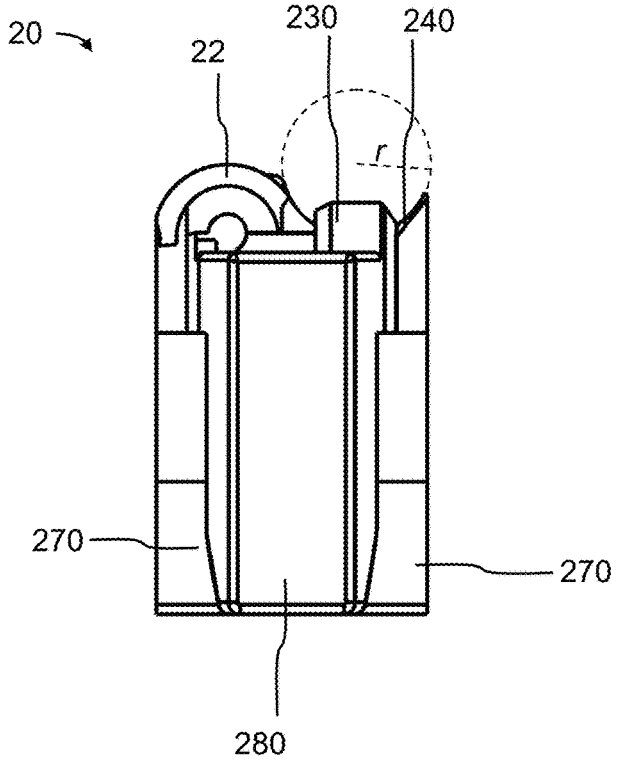
FIG. 10 shows a front plan view of the follower of FIG. 6.

Measured another way, depicted representatively in FIG. 9B, the ramp 230 defines a guidance angle γ between the ramp surface 230*a* and the longitudinal axis $B_a$ of the barrel B of the upper receiver UR sufficient that the bullet portion of the cartridge does not contact an interior surface of the barrel extension $B_e$ of the upper receiver UR until the bullet portion reaches the barrel B. The guidance angle γ may vary depending on the make and model of the firearm, the upper receiver, and/or the cartridge to be used with the ammunition magazine. For example, the guidance angle γ for a ramp 230 of a follower 20 consistent with the present disclosure for use with a 5.7×30 bottleneck round may be about 11° to about 12°, such as about 11.5°. In another non-limiting example, the guidance angle γ for use with a 5.56 caliber cartridge may be about 10° to about 11°, such as about 10.6°. More generally, however, the guidance angle γ is about 2° to about 20°, for example about 2°, about 3°, about 4°, about 5°, about 6°, about 7°, about 8°, about 9°, about 10°, about 11°, about 12°, about 13°, about 14°, about 15°, about 16°, about 17°, about 18°, about 19°, or about 20°. In some embodiments, the guidance angle γ is about 11°. In some embodiments, the guidance angle γ is about 10.6°. In some embodiments, the guidance angle γ is about 2.5° to about 20°. In some embodiments, the guidance angle γ is about 10° to about 12°. In some embodiments, the guidance angle γ is about 16°.

In some embodiments, the ramp 230 includes a concave top surface 230*a* and/or a longitudinal channel 230*a* oriented parallel to the longitudinal length of the ammunition cartridge and configured to align the ammunition cartridge with a center line CL of the ramp 230 and towards the chamber as the ammunition cartridge is advanced into the chamber. In some embodiments, the shoulder of the last ammunition cartridge within the magazine 10 contacts and slides along the concave top surface 230*a* as the last ammunition cartridge is advanced into the chamber, but the bullet portion of the ammunition cartridge does not contact the ramp 230. In some embodiments, the bullet portion of the ammunition cartridge also does not contact a feed ramp of the lower receiver, but instead is forced into the chamber without contacting any interior surface of the lower receiver.

In some embodiments, a channel 240 is disposed proximal to the ramp 230 and is configured to align the ammunition cartridge with the center line CL of the ramp 230. The channel 240, when present, includes an interior radius orthogonal to the longitudinal length of an associated ammunition cartridge and approximately the same radius as or slighter larger than the outer radius of the ammunition cartridge.

The tail fin 260 slidably mates with the tail recess 160. The tail fin 260 generally has a width of about 25% to about 50% of the overall width of the magazine housing 10, for example about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the overall width of the magazine housing 10.

In operation, the first loaded ammunition round is inserted laterally to contact the ramp 230, and is held to one side of the cavity 120 due to the cartridge-shaped protrusion 220 contacting the ammunition round casing. The second loaded ammunition round contacts both the first loaded ammunition round and the cartridge-shaped protrusion 220, and is held to the other side of the cavity 120.

As shown best in FIGS. 9A-9B, the follower 20 may also include a spring hook 290 between the front leg 280 and the rear leg 270. The spring hook 290, when present, reversibly mates with the top end of the spring 250.

In some embodiments, the present disclosure provides a magazine housing 10 and associated follower 20 that, together with a spring, form an ammunition magazine. The follower 20 is disposed within a cavity 120 of the magazine housing, and is configured to force one or more ammunition cartridges towards the top end of the magazine housing 10 and into an upper receiver of a firearm (not shown). The magazine housing 10 includes a catch 110 on its outer face, a cavity 120 in which the follower 20 and an associated spring 250 are disposed, a tail recess 160 extending vertically through the magazine housing 10, and a floor plate receiver 140; while the follower 20 includes a cartridge-shaped protrusion 220 and a ramp 230 disposed on its top surface 210, a front leg 280, a rear leg 270, and a tail fin 260 disposed on the rear leg 270. The upper surface of the cartridge-shaped protrusion 220 is disposed at an angle β of about 1.4-1.8° relative to the top surface 210 of the follower 20, while the top surface of the ramp 230 is disposed at an angle α of about 10-16° relative to the top surface 210 of the follower 20. The follower 20 and its ramp 230 operate to direct cartridges loaded within the cavity 120 of the ammunition magazine into substantially the center of a chamber of a lower receiver (not shown) without the bullet portion of the cartridge contacting an inner surface of the lower receiver until the bullet portion enters the barrel of the firearm.

In some embodiments, such as those generally consistent with FIGS. 1-10, the ammunition magazine is configured to hold two stacks of cartridges that are partially interlaced (e.g., a double stack configuration).

In other embodiments, the ammunition magazine is configured to hold a single stack of cartridges, each resting on top of the cartridge below (e.g., a single stack configuration). In such embodiments, the follower 20 includes the ramp 230 and optionally the channel 240, but does not include the cartridge-shaped protrusion 220. The ramp 230 and, if present, the channel 240 are disposed mid-way laterally across the width of the follower surface 210, rather than being offset towards one side of the follower surface 210 as shown in the double stack embodiment depicted specifically in FIGS. 1-10.

Regardless of whether the ammunition magazine enables a single stack or a double stack configuration of loaded cartridges, the magazine housing 10 and the follower 20 cooperate to enable feeding of an ammunition cartridge from the cavity 120 into a chamber of an upper receiver without enabling contact between the bullet portion of the cartridge and the feed ramp of the upper receiver (not shown). By reducing or eliminating contact between the ammunition cartridge and the feed ramp, damage to the cartridge—and therefore risk and rate of cartridge misfeed and misfire—is also reduced or eliminated. In some embodiments, the rate of cartridge misfeed and misfire associated with an ammunition magazine of the present disclosure is reduced by at least about 50% compared to an ammunition magazine including a follower inconsistent with the present disclosure, for example by about 50%, by about 55%, by about 60%, by about 65%, by about 70%, by about 75%, by about 80%, by about 85%, by about 90%, by about 95%, by about 96%, by about 97%, by about 98%, by about 99%, or by about 100%.

Figure 11:
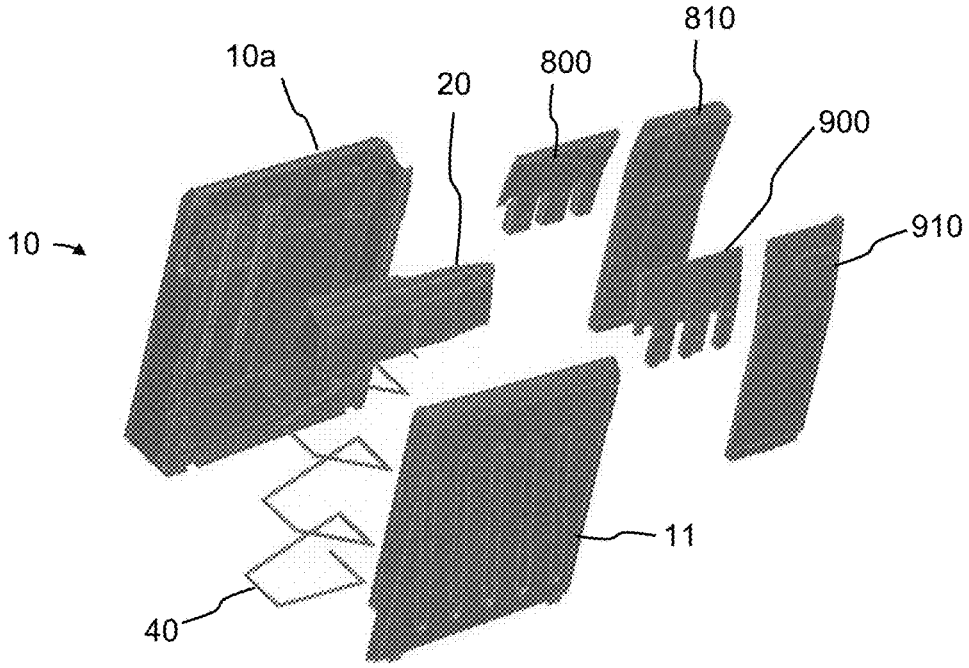
FIG. 11 shows an exploded view of a magazine housing consistent with one embodiment of the present disclosure.
Figure 12:
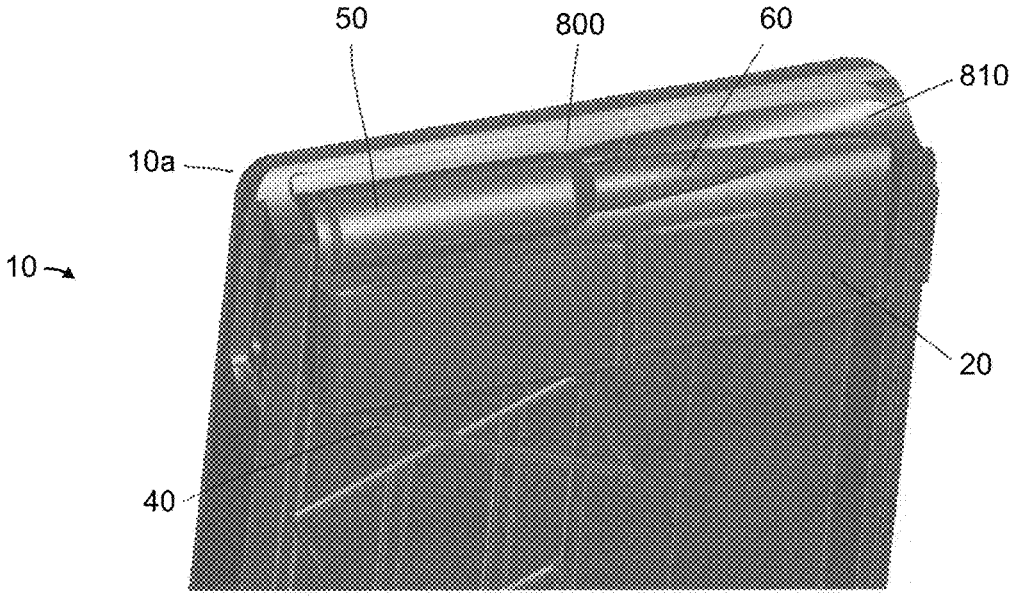
FIG. 12 shows a side view of the interior of a magazine housing consistent with one embodiment of the present disclosure.
Figure 13:
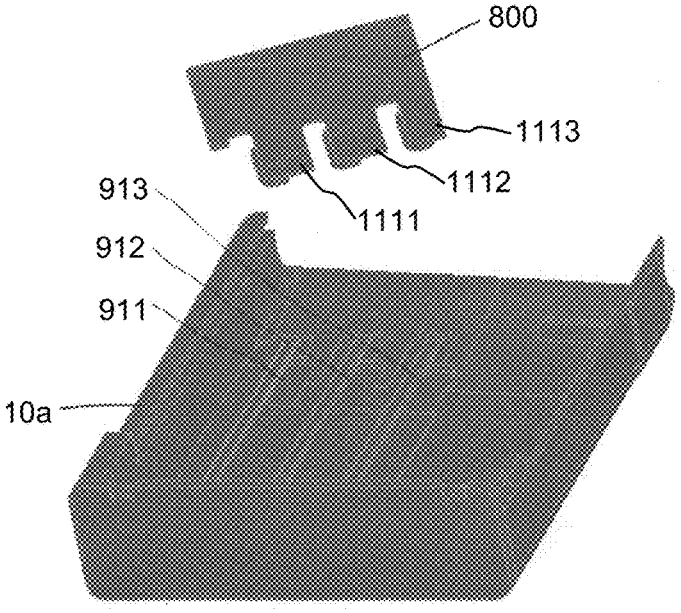
FIG. 13 shows a side view of the interior of a magazine housing and a left-hand feed lip insert consistent with one embodiment of the present disclosure.

Referring now to FIG. 11-13, an alternative embodiment is shown of a magazine housing, intended to be mounted into a rifle receiver of a firearm. In one embodiment the magazine housing includes a base 10*a*, a removable plate 11, a left-hand feed lip insert 800 and a right-hand feed lip insert 900; a left-hand feed ramp insert 810 and a right-hand feed ramp insert 910; a magazine follower 20 and a spring 40.

Referring specifically to FIG. 12, a left-hand feed lip insert 800 and left-hand feed ramp insert 810 are disposed on the inside of the base 10*a*. A right-hand feed lip insert 900 and right-hand feed ramp 910 are disposed on the inside of a removable housing plate 11 (not shown), which is substantially a mirror image of the magazine housing base 10*a* illustrated in FIG. 12. The removable housing plate 11 including the right-hand feed lip insert 900 and the right-hand feed ramp 910 reversibly mates with the magazine housing base piece 10*a* including the left-hand feed lip insert 800 and the left-hand feed ramp 810 to define a magazine housing. A magazine follower 20 is disposed within the magazine housing, and is pressurized by a spring 40 configured to elevate a cartridge 50 against left-hand feed lip insert 800 and right-hand feed lip insert 900. The left-hand feed lip insert 800 and the right-hand feed lip insert 900 cooperate to hold the cartridge in place generally in midway between the outer wall of the magazine housing base 10*a* and the outer wall of the removable housing plate 11.

Referring now to FIG. 13, the magazine housing base 10*a* may in some embodiments include one or more key seat slotted pockets 911, 912, 913 disposed in the left inner side wall to accept and mate with tabs 1111, 1112, 1113 respectively of the left-hand feed lip insert 800. In such embodiments, the key seat slotted pockets 911, 912, 913 are configured to accept tabs 1111, 1112, 1113 such that the tabs 1111, 1112, 1113 are slidably engaged with the magazine housing base 10*a* to enable smooth and reliable up-and-down movement of the left-hand feed lip insert 800 within the magazine housing. Similarly, the magazine housing plate 11 may include one or more key seat slotted pockets 921, 922, 923 disposed on the interior of magazine housing plate 11 to accept tabs 1121, 1122, 1123 of the right-hand lip insert 900. Key seat slotted pockets 921, 922, 923 are configured to slidably mate with tabs 1121, 1122, 1123 to enable smooth and reliable up-and-down movement of the right-hand feed-lip insert 900 within the magazine housing.

Figure 14:
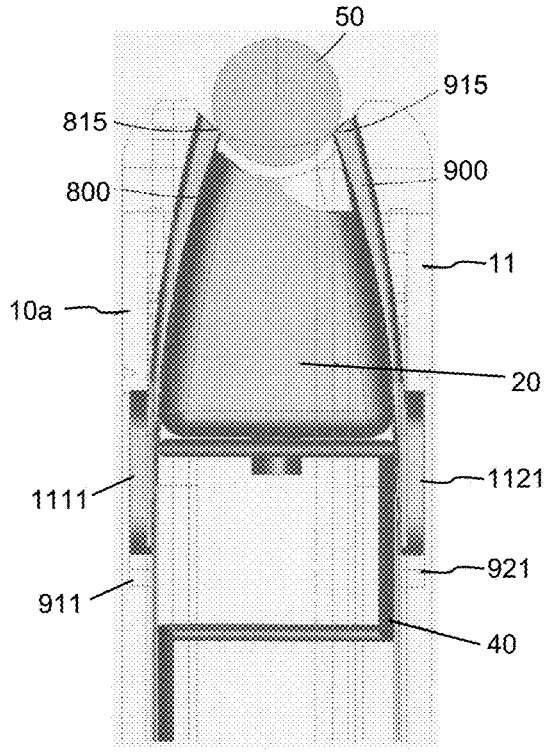
FIG. 14 shows a rear sectional view of the magazine housing of FIG. 11.
Figure 15:
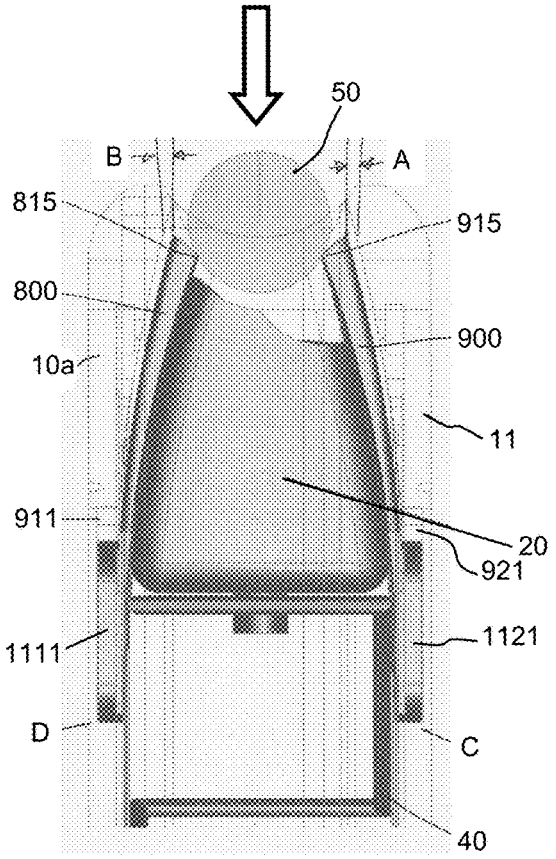
FIG. 15 shows a rear sectional view of the magazine housing of FIG. 11.
Figure 16:
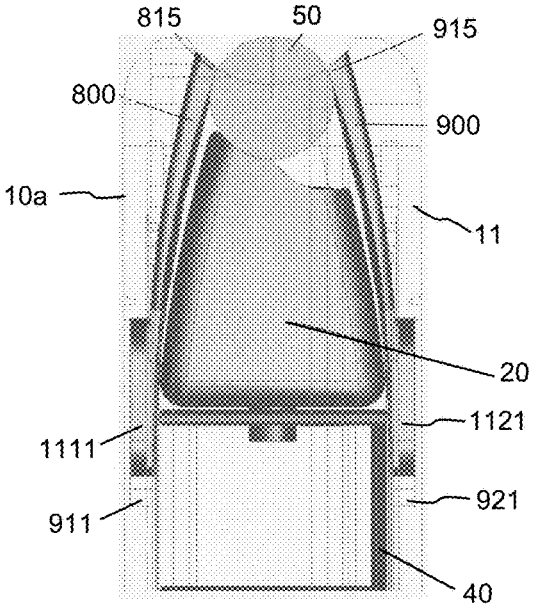
FIG. 16 shows a rear sectional view of the magazine housing of FIG. 11.

Referring now to FIGS. 14-16, a rear cutaway view of one embodiment of a magazine of the present disclosure shows an assembled magazine box 10 holding a cartridge 50 in position between the left-hand feed lip insert 800 and the right-hand feed lip insert 900.

Referring specifically to FIG. 14, a rear view of an assembled magazine box shows the left-hand feed lip insert 800 and the right-hand feed lip insert 900 in their topmost positions of the magazine housing 10. The magazine housing base 10*a* and removable plate 11 are shown assembled for use as magazine housing 10. Magazine follower 20 raises the cartridge into position between left-hand feed lip insert 800 and right-hand feed lip insert 900 due to upward pressure from follower spring 40. The key seat slotted pocket 911 of the magazine housing base 10*a* and the key seat slotted pocket 921 of the removable plate 11 both have empty clearances at bottom locations with the left-hand feed lip insert 800 and the right-hand feed lip 900 both in their topmost positions. Cartridge 50 is shown at the magazine top opening, resting on inside corners 815 and 915 of left-hand feed lip insert 800 and right-hand feed lip insert 900, respectively.

FIG. 15 shows a cartridge 50 pressed downward (arrow) against inside corners 815 and 915 of left-hand feed lip insert 800 and right-hand feed lip insert 900, respectively. Magazine follower 20 and spring 40 are also shown moving away from cartridge 50 in a downward direction (arrow). When the cartridge 50 is pressed against inside corners 815 and 915 of left-hand feed lip insert 800 and right-hand feed lip insert 900 respectively, any empty clearance remaining for key seat slotted pocket 911 is filled by the tab 1111 until the left-hand feed lip insert 800 reaches location D. Simultaneously, the key seat slotted pocket 921 is filled by the tab 1121 until the right-hand feed lip 900 reaches location C. Upon discontinuation travel of the left-hand feed lip insert 800 and the right-hand feed lip insert 900, continued downward pressure of cartridge 50 will cause left-hand feed lip insert 800 and right-hand feed lip insert 900, both of flexible construction, to widen into positions B and A as shown in FIG. 15. When the left-hand feed lip insert 800 flexes to position B and the right-hand feed lip insert 900 flexes to position A, the cartridge 50 may pass by inside corners 815 and 915 and into the interior of the magazine housing.

As shown in FIG. 16, a cartridge 50 has already been forced beyond the inside corner 815 of the left-hand feed lip and the inside corner 915 of the right-hand feed lip insert 900. The cartridge 50 is retained in this configuration until the bolt of a firearm forces the cartridge 50 from the magazine into a chamber, or until another cartridge 50 is forced into the magazine on top of the first cartridge 50. In some embodiments, both the left-hand feed lip 800 and the right-hand feed lip 900 are sufficiently flexible to enable their respective side walls to relax from their flexed positions A/B (FIG. 15) to prevent cartridge 50 from exiting the top of the magazine opening. The flexible characteristics of the left-hand feed lip 800 and the right-hand feed lip 900 also enable the cartridge 50 to be gently but firmly secured approximately centrally between the magazine housing base 10*a* and the removable housing plate 11 (e.g., laterally central). Decompression of spring 40 will elevate the magazine follower 20, pressing the cartridge 50 into the inner surfaces of the left-hand feed lip insert 800 and the right-hand feed lip insert 900 to allow both to be elevated into their top-most position.

The process of loading cartridges as described above may be repeated until the magazine housing 10 reaches full capacity. In one embodiment, loading cartridges 50 from top to bottom is improved by the elasticity of both the left-hand feed lip insert 800 and the right-hand feed lip insert molding to the cartridge 50 holding the cartridge 50 in the desired location. Another improvement provided by the elastic material of the left-hand feed lip insert 800 and right-hand feed lip insert 900 is the prevention of scoring to any surfaces of cartridges 50 during use.

In some embodiments, the left-hand feed lip insert 800 and the right-hand feed lip insert 900 cooperate to position the top-most cartridge 50 substantially centrally between the left-hand feed lip insert 800 and the right-had feed lip insert 900, reducing the rate of cartridge misfeeds into the chamber of an associated lower receiver/firearm.

Figure 17A:
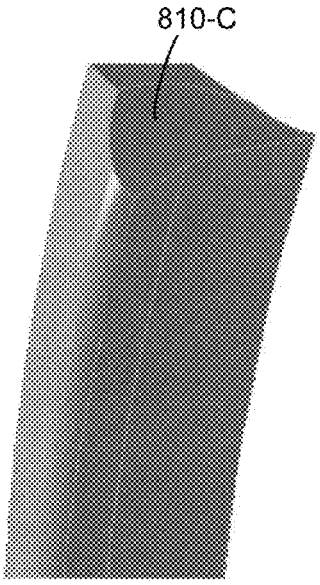
FIG. 17A shows a rear view of a left-hand feed ramp insert consistent with an embodiment of the present disclosure.
Figure 17B:
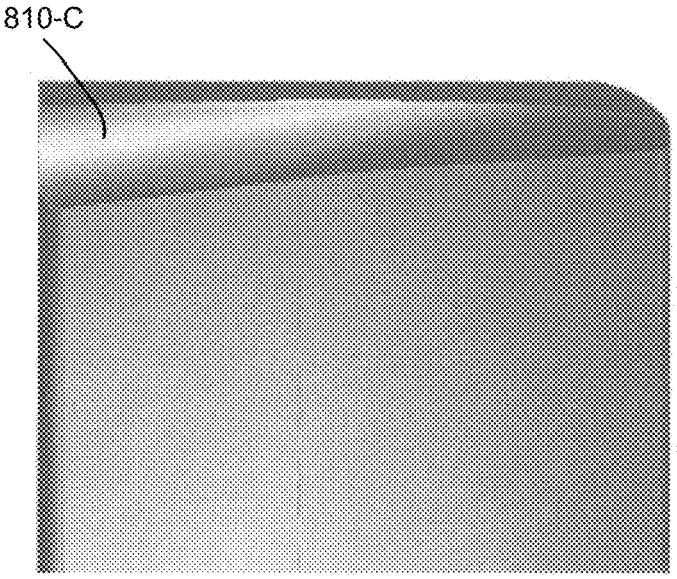
FIG. 17B shows a front view of the left-hand feed ramp insert of FIG. 17A.
Figure 18:
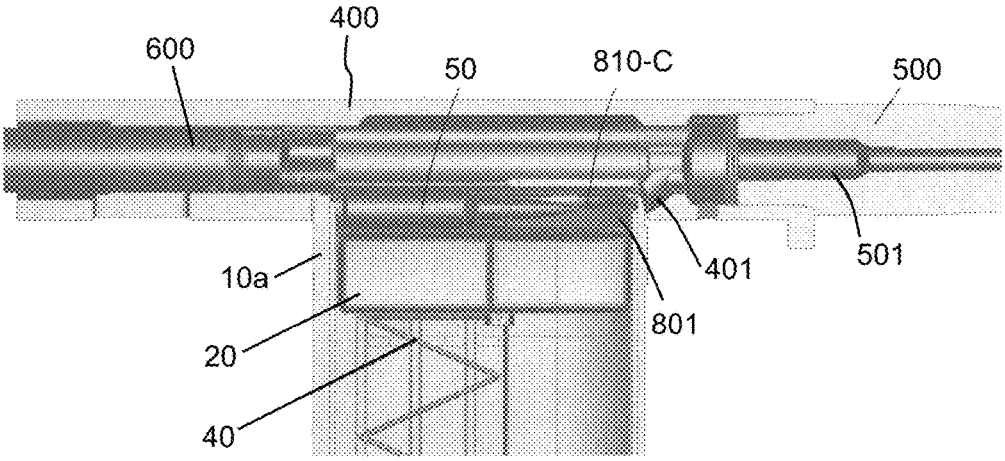
FIG. 18 shows a magazine housing and receiver assembly in accordance with one embodiment of the present disclosure.

Referring now to FIGS. 17A-17B, the left-hand feed lip insert may in some embodiments include a ramping surface 810-C. A right-hand feed ramp 910 (e.g., consistent with that shown in FIG. 11) may be substantially a mirror image of the left-hand feed ramp insert 810 shown in FIGS. 17A-17B, and may include a ramping surface 910-C (not shown). The ramping surfaces 800-C/900-C, when present, improve alignment of the cartridge 50 while the bolt forces the cartridge 50 into a chamber.

Referring now specifically to FIGS. 18-22, in some embodiments a magazine housing assembly 10 including a base 10*a*, a left-hand feed lip insert 800, left-hand feed ramp insert 810, a right-hand feed lip insert 900 (not shown for clarity), a right-hand feed ramp insert 910 (not shown for clarity), a magazine follower 20, and a spring 40, is assembled to form a magazine box, which is then mounted onto a receiver 400. Receiver 400 is shown in cutaway view for clarity, and includes a bolt 600 configured to move towards the barrel 500 to force cartridges 50 from the magazine box into the firing chamber 501 of barrel 500. In one embodiment, the receiver 400 also includes an integral feed ramp 401 to further assist in guiding the cartridge 50 into position in the firing chamber 501.

Figure 19:
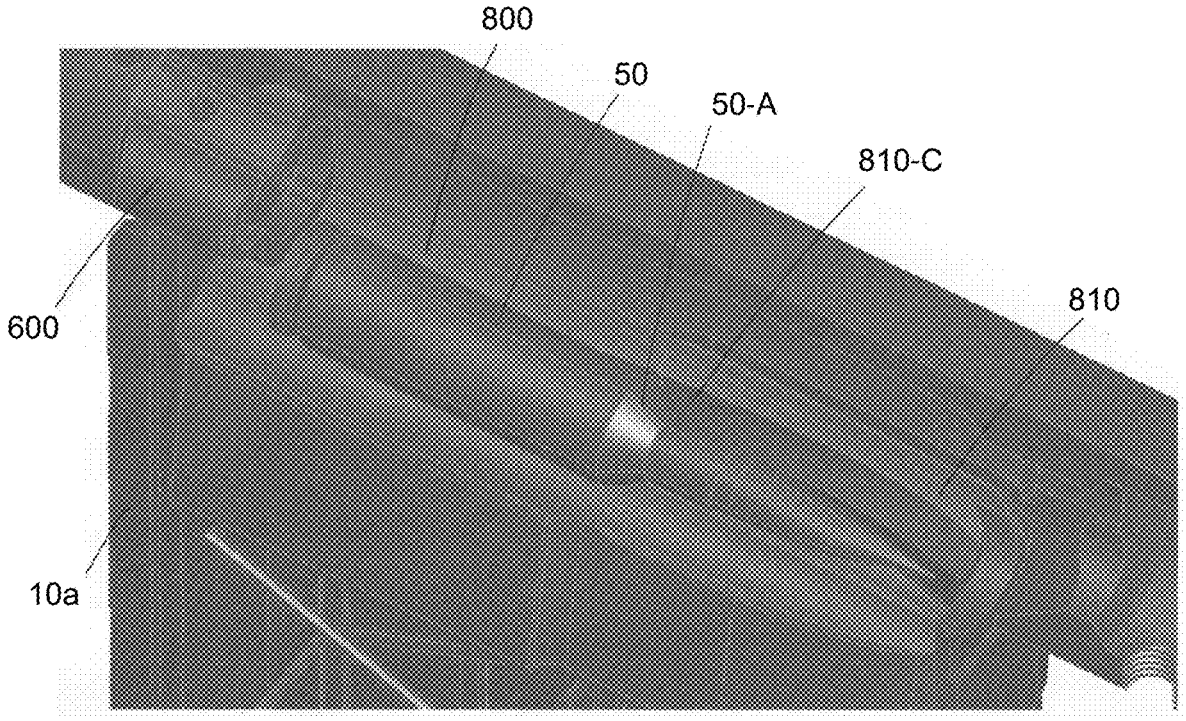
FIG. 19 shows a top plan view of a magazine housing and receiver assembly in accordance with one embodiment of the present disclosure.
Figure 20:
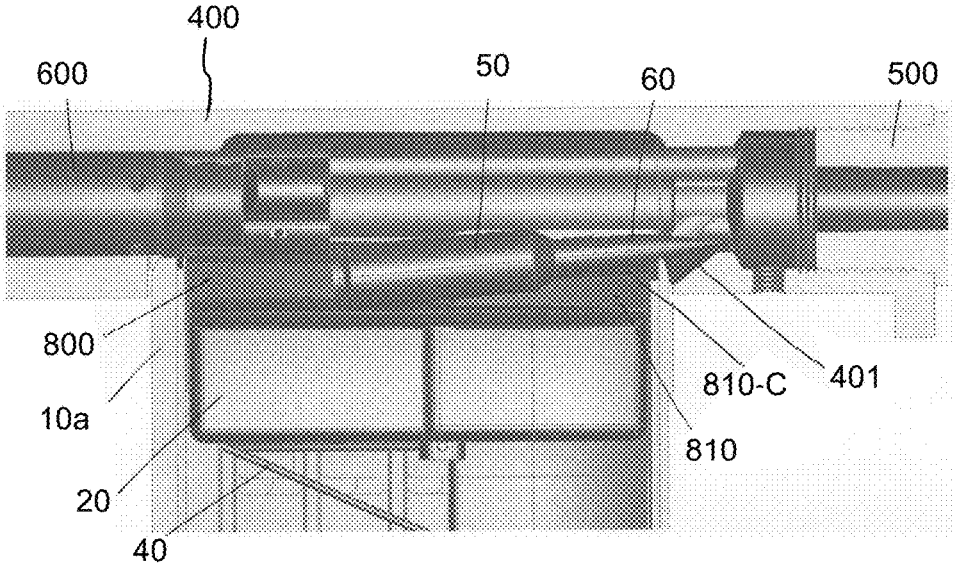
FIG. 20 shows a magazine housing and receiver assembly in accordance with one embodiment of the present disclosure.
Figure 21:
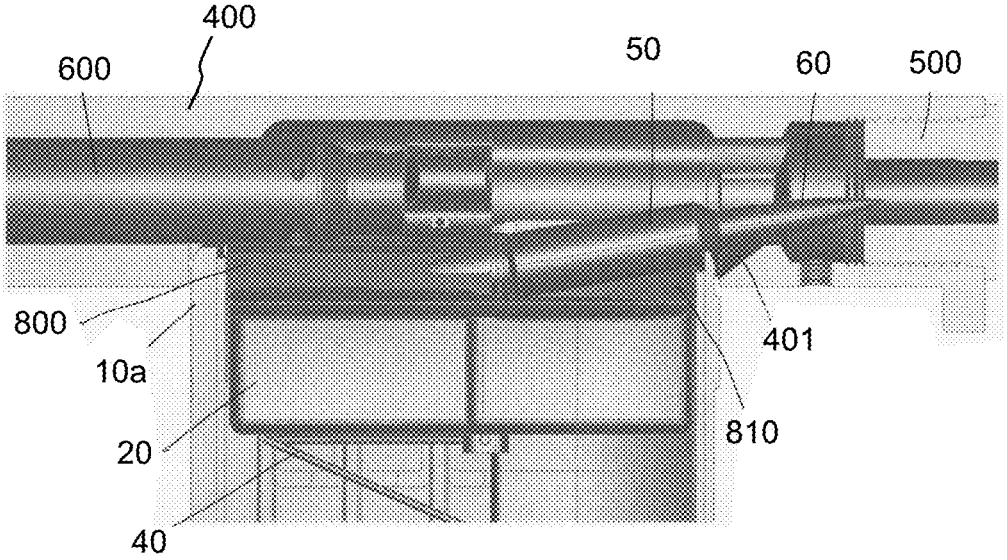
FIG. 21 shows a magazine housing and receiver assembly in accordance with one embodiment of the present disclosure.
Figure 22:
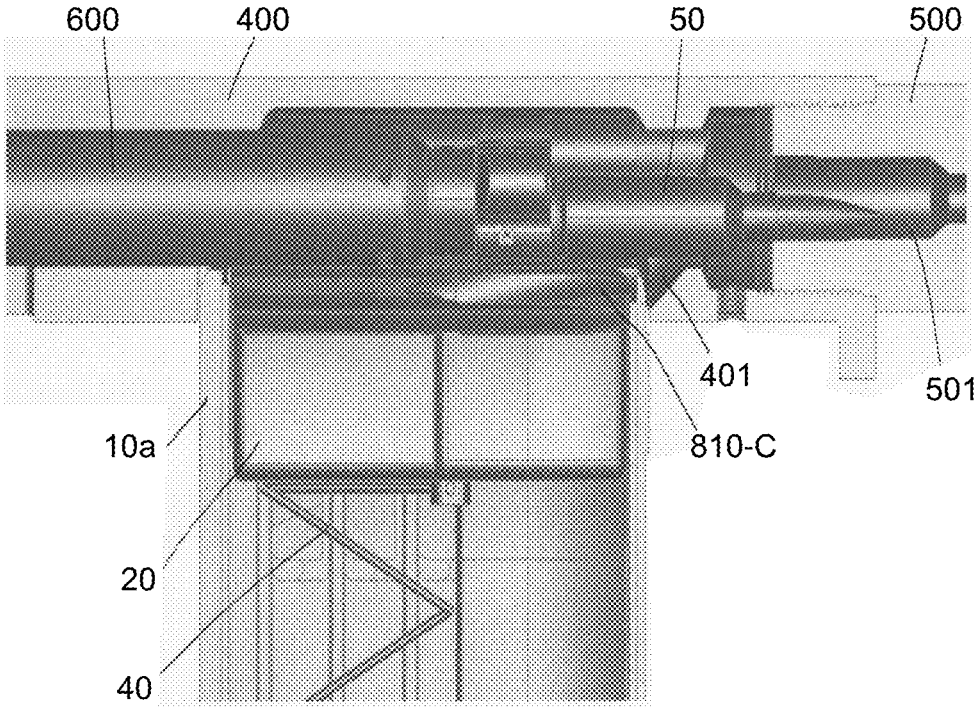
FIG. 22 shows a magazine housing and receiver assembly in accordance with one embodiment of the present disclosure.

Referring now to FIG. 19, the bolt 600 is in a retracted position (away from the barrel 500). When the bolt is in this retracted position, cartridge 50 is forced upward into position between the left-hand feed lip insert 800 and the right-hand feed lip insert 900. After the cartridge 50 is elevated to this position, the bolt 600 may be moved towards the chamber 501 to slidably engage the cartridge 50. As the bolt 600 continues to advance towards the barrel 500, the shoulder 50-A of cartridge 50 contacts the ramping surface 810-C of left-hand feed ramp insert 810 and the ramping surface 910-C of the right-hand feed ramp insert 910 (not shown for clarity). Continued forward movement of the bolt 600 continues to force the cartridge 50 along the ramping surface 810-C of the left-hand feed ramp insert 810 and along the ramping surface 910-C of the right-hand feed ramp insert 910 (not shown), forcing the bullet 60 portion of the cartridge 50 to move past the feeding ramp 401 without contacting the feeding ramp 401. As bolt 600 continues to advance, the cartridge 50 continues to slide towards the barrel 500, releasing cartridge 50 from the left-hand feeding lip insert 800 and its ramping surface 810-C, and from the right-hand feeding lip insert 900 and its ramping surface 910-C (not shown).

Upon release of the cartridge 50 into the chamber 501, the bolt 600 retracts and the next cartridge 50 available in the magazine 10 will be forced upward to the left-hand feeding lip insert 800 and the right-hand feeding lip insert 900 (not shown) and into position for loading into the chamber 401. Upon retraction of the bolt 600, the spent cartridge 50 is ejected from the receiver 400 and the next cartridge 50 available in the magazine 10 can repeat the cycle described above, with each cartridge 50 contacting the left-hand feed ramp surface 810 and the right-hand feed ramp surface 910 as each cartridge is forced from the magazine 10 into the chamber 401, until all cartridges 50 in the magazine 10 have been expended. In some embodiments, no bullet portion 60 of cartridges 50 within a magazine 10 contact inner surfaces of the firearm before the bullet portions 60 are expelled through the barrel of the firearm (at which point the bullet portions 60 may each contact inner surfaces of the barrel). Magazines 10 consistent with the present disclosure operate to prevent the bullet portions 60 of cartridges 50 from disruption, damage, or scoring during the process of transferring the cartridge 50 and its associated bullet portion 60 from the magazine 10 to the chamber 401. Further, the left-hand feed ramp 810 and right-hand feed-ramp 910 inserts comprise, consist, or consist essentially of a flexible material, such as rubber, plastic, foam, polymer, or a combination thereof, substantially reduce or prevent scoring to the cartridge case during the loading process.

Figure 23:
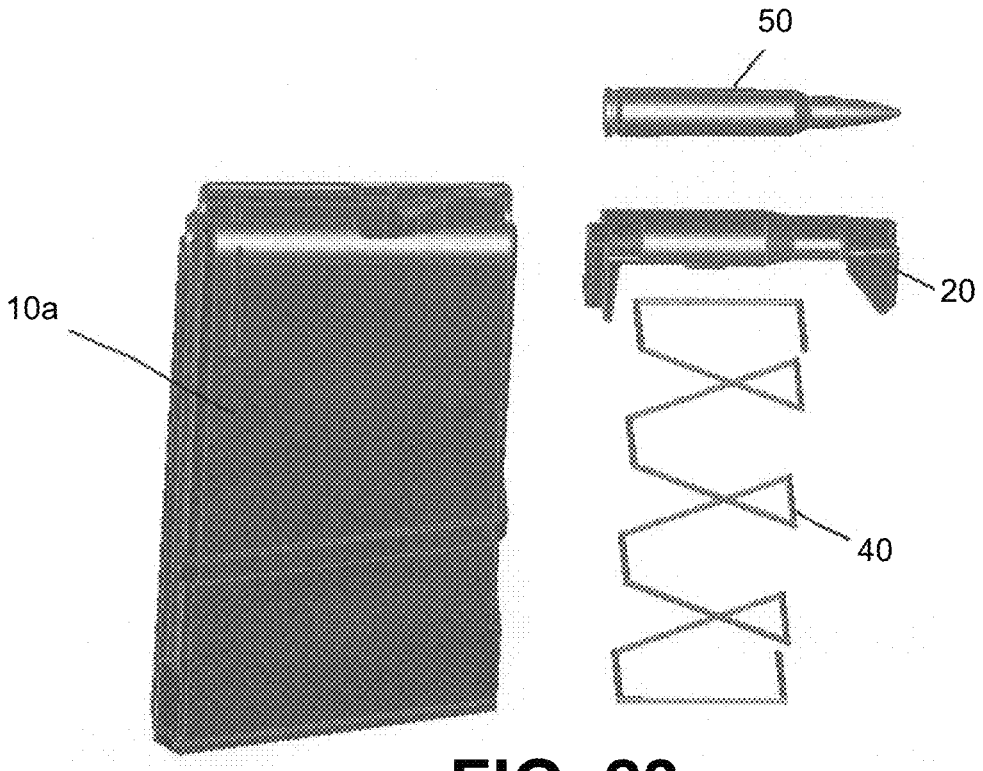
FIG. 23 is an exploded view of a magazine housing consistent with one embodiment of the present disclosure.

Referring specifically to FIGS. 23-29, another embodiment of a magazine 10 consistent with the present disclosure includes a magazine housing base 10*a*, a follower 20, and a spring 40. Also, shown in FIG. 23 is a bottle-neck style cartridge 50 consistent with the type of ammunition round used by at least one embodiment of the present disclosure. The magazine 10 of may have a double row or double-stack design as shown in FIGS. 23-29. In another embodiment, the magazine housing 10 may be configured to hold only a single row of cartridges 50.

Figure 24:
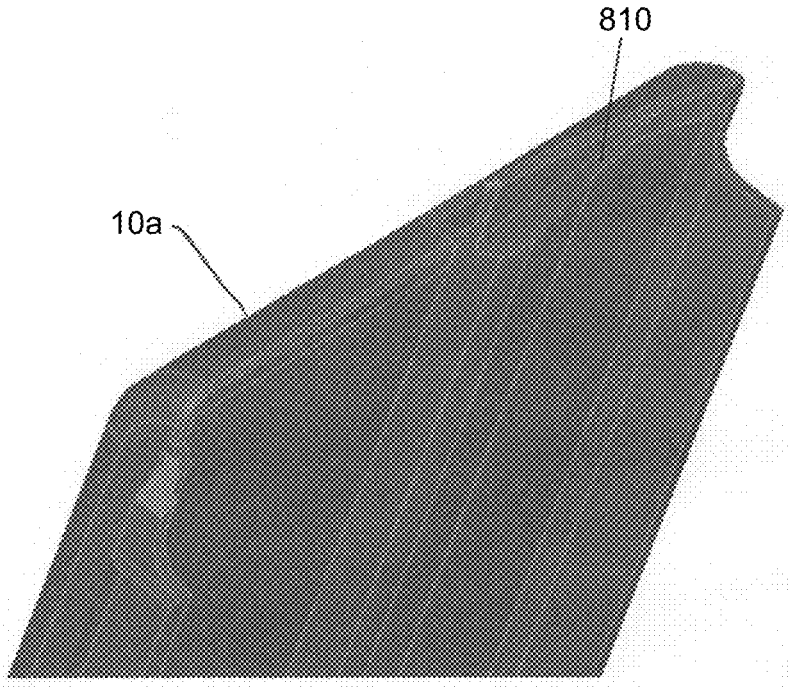
FIG. 24 is a side view of the interior of a magazine housing consistent with one embodiment of the present disclosure.

FIG. 24 illustrates a magazine housing base 10*a* including a left-hand feed ramp surface 810 integrally formed as a protrusion on the inner surface of magazine housing base 10*a*. Similarly, right-hand feed ramp surface 910 is a substantially mirror-image of the left-hand feed ramp surface 810, and is also integrally formed on the inner surface of the opposite half of the magazine housing base 10*a* (not shown for clarity), which may be substantially a mirror image of the illustrated half of the magazine housing base 10*a*.

Figure 25:
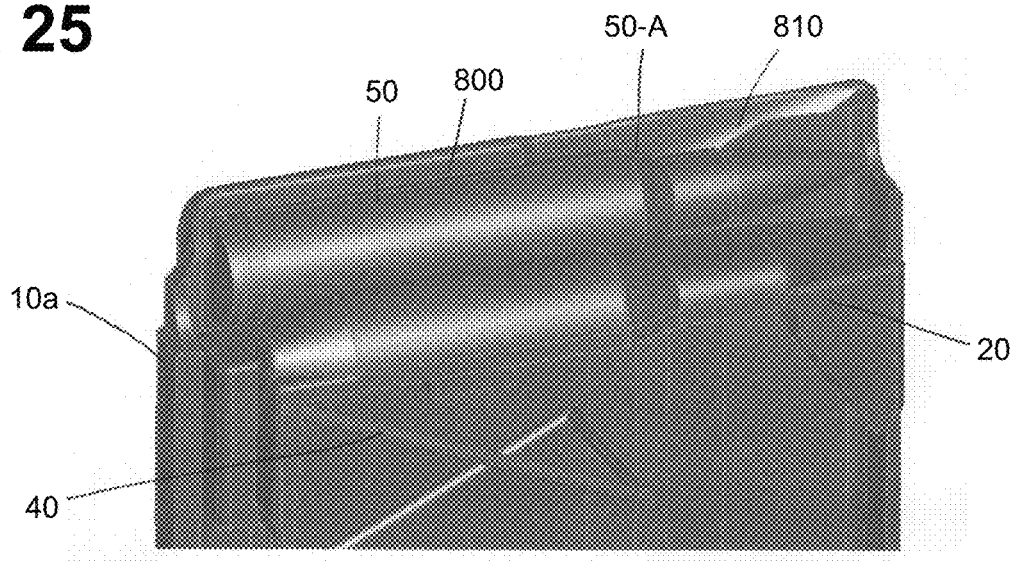
FIG. 25 is a side view of the interior of a magazine housing consistent with one embodiment of the present disclosure.
Figure 26:
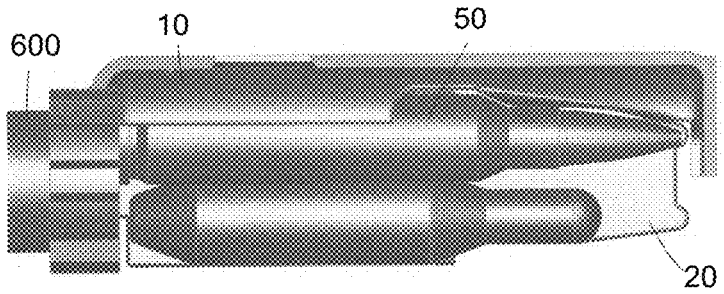
FIG. 26 is a top view of the interior of a magazine housing and a bolt consistent with one embodiment of the present disclosure.
Figure 27:
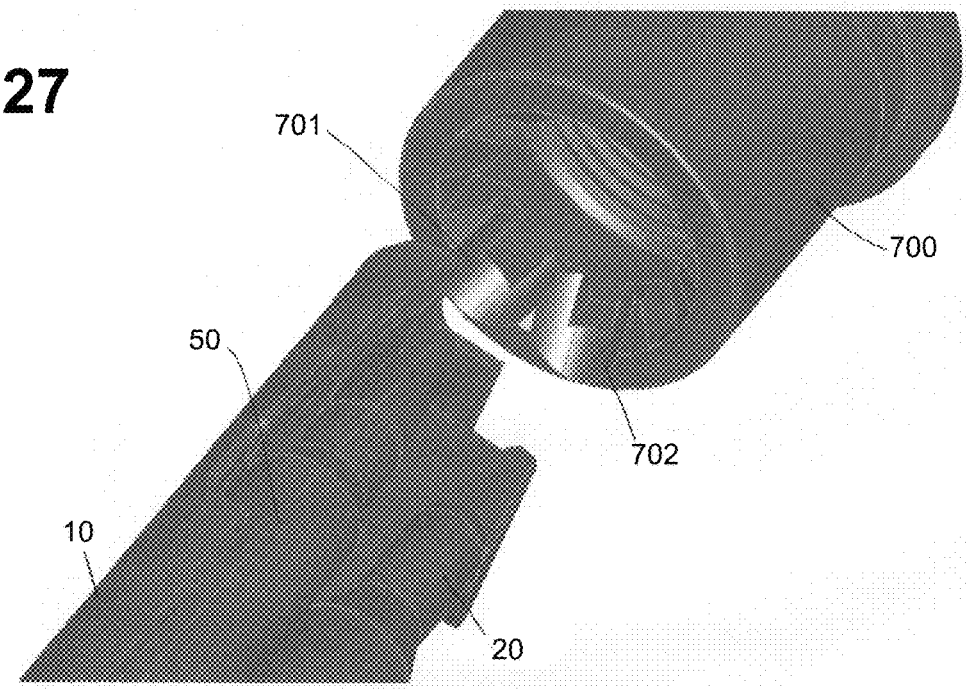
FIG. 27 is a perspective view of a magazine housing and a barrel extension consistent with one embodiment of the present disclosure.
Figure 29:
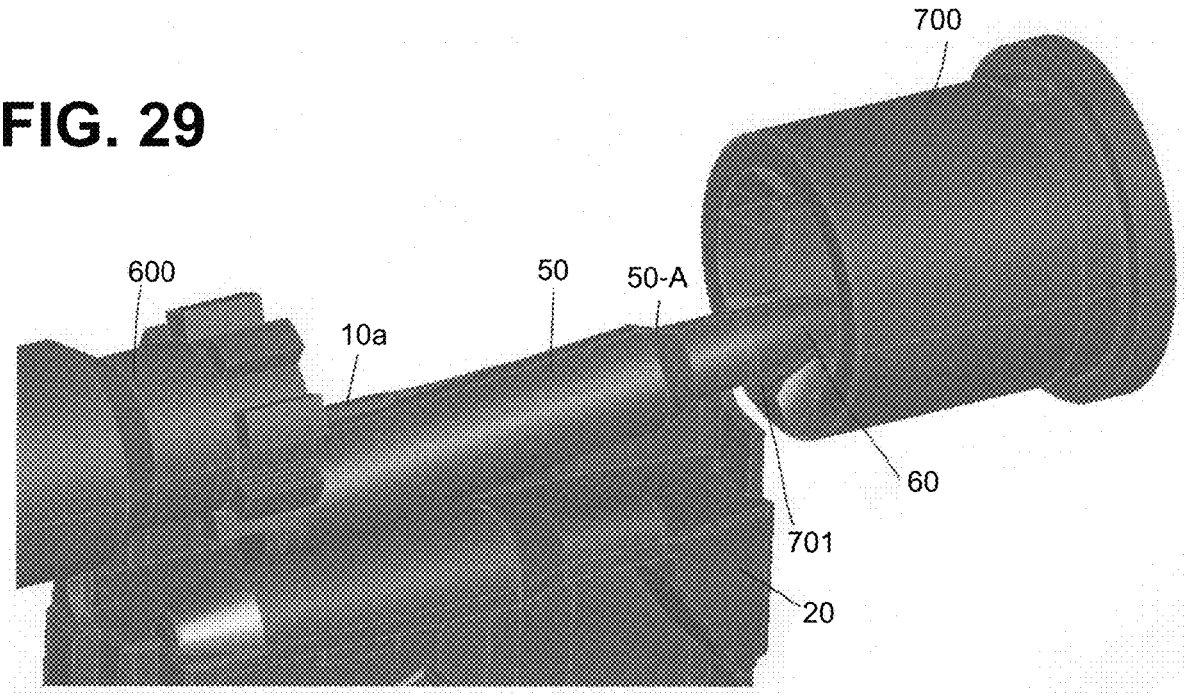
FIG. 29 is a side view of a magazine housing, bolt, and barrel extension consistent with one embodiment of the present disclosure.

As shown in FIG. 25, cartridge 50 is loaded into magazine 10 by compressing the magazine follower 20 and the magazine spring 40 downward. When the follower 20 and the spring 40 are compressed, the cartridge 50 is held against the left-hand feed lip 800 and the right-hand feed lip 900 (not shown). Cartridge 50 may have a conventional bottle neck design including a shoulder 50-A that contacts the feed ramp surfaces 810/910. An additional cartridge 50 loaded into the magazine 10 will depress the initial cartridge 50 into the interior of magazine 10 along with the follower 20 by further compressing the spring 40. As shown in FIG. 26, the bolt 600 of a firearm initially contacts the rear surface of the cartridge 50 when advancing towards the chamber 501. FIG. 27 shows a magazine housing 10 aligning a cartridge 50 with a barrel extension 700 that includes a left-hand loading slot 701 and a right-hand loading slot 702. Loading slots 701 and 702 are configured to help guide a cartridge from a conventional double-stack ammunition magazine into the chamber 501.

Figure 28:
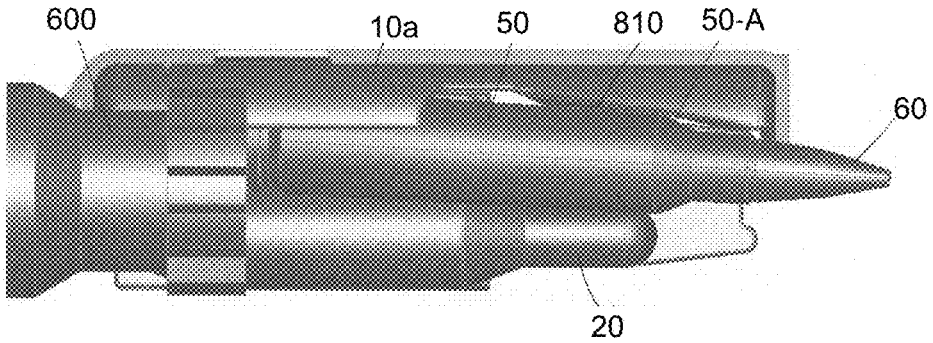
FIG. 28 is a top view of a magazine housing and a bolt consistent with one embodiment of the present disclosure.

FIG. 28 is an isometric view of FIG. 27, and illustrates the cartridge 50 being advanced by the bolt 600 until the cartridge shoulder 50-A contacts the feed ramp surfaces 810/910 of the magazine 10. The feed ramp surfaces 810/910 guide cartridge shoulder 50-A away from the outer walls of the magazine 10 and towards the center of the chamber 501 such that the bullet 60 does not contact the loading slots 701 and 702 of the barrel extension 700, or any other interior surface of the barrel extension 700.

Figure 30:
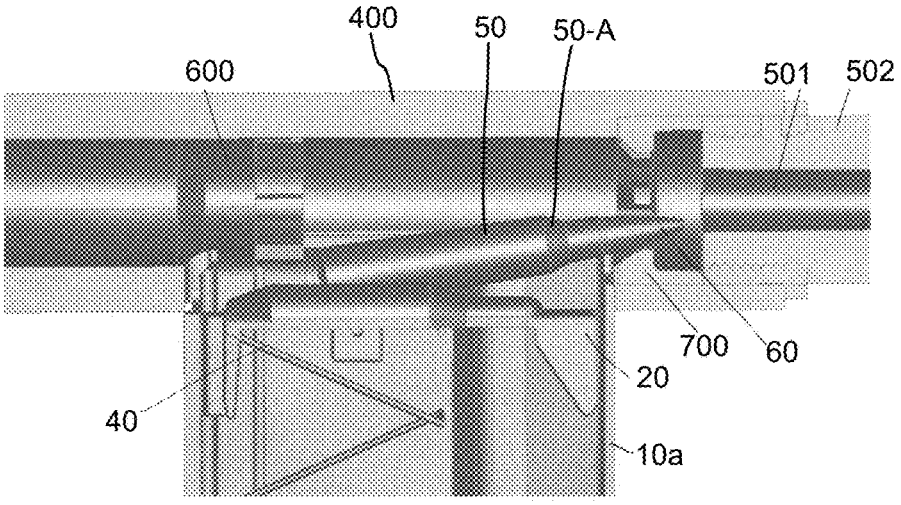
FIG. 30 is a side view of a magazine housing and receiver assembly in accordance with one embodiment of the present disclosure.
Figure 31:
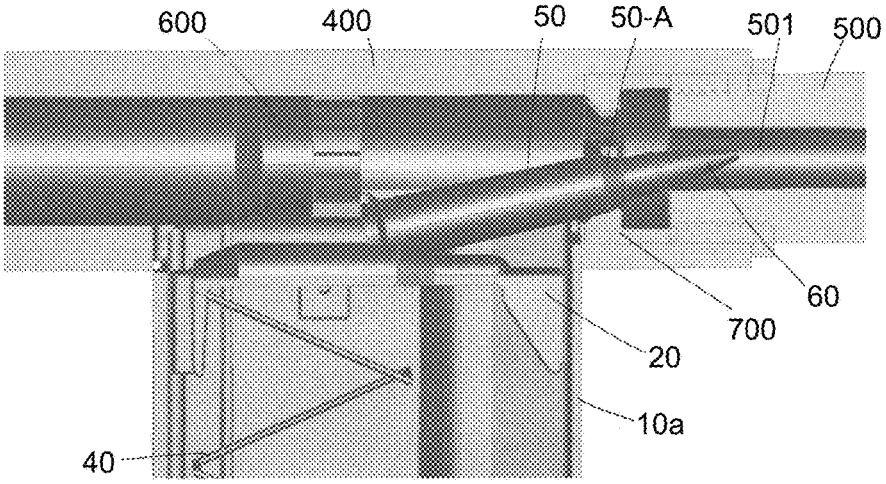
FIG. 31 is a side view of a magazine housing and receiver assembly in accordance with one embodiment of the present disclosure.
Figure 32:
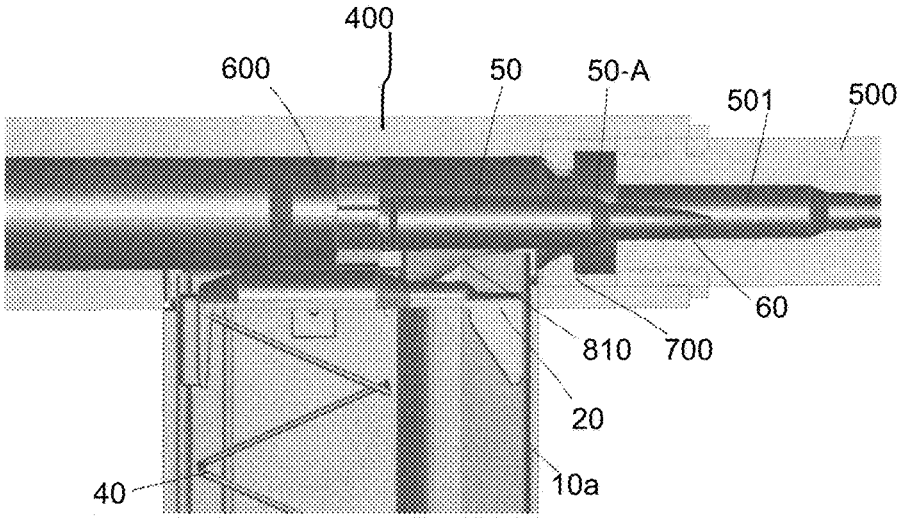
FIG. 32 is a side view of a magazine box and receiver assembly in accordance with one embodiment of the present disclosure.

Referring specifically to FIG. 30-32, a magazine 10 is shown mounted to a receiver 400 with its bolt 600 pushing the cartridge 50 along the surface of feed ramps 810/910 to guide the cartridge 50 and its bullet 60 through the barrel extension 700 and into the chamber 501 of the barrel 500. The bullet 60 of the cartridge 50 does not contact interior surfaces of the barrel extension 700 as it is forced into the firing chamber 501 of barrel 500. Upon retraction of the bolt 600, the spent cartridge 50 is ejected from the receiver 400 and the next cartridge 50 available in the magazine 10 can repeat the cycle described above, with each successive cartridge 50 alternately contacting the left-hand feed ramp surface 810 and the right-hand feed ramp surface 910, until all of the cartridges 50 in the magazine 10 have been expended. In such embodiments, all cartridges 50 in a double-stack magazine 10 consistent with the present disclosure are expelled from the magazine 10 without disruption or scoring of the bullets 60 during the loading process.

In some embodiments, the present disclosure provides an ammunition magazine configured to bottom-feed a plurality of ammunition cartridges into an upper receiver of a firearm, the ammunition magazine comprising: a magazine housing including a catch and a floor plate receiver; a spring within the magazine housing; a floor plate retainer disposed at a bottom end of the spring; a floor plate disposed at a bottom end of the magazine housing and reversibly mated with the floor plate retainer; and a magazine follower disposed at a top end of the spring, the magazine follower including: a cartridge-shaped protrusion on a top surface, a ramp on the top surface and disposed adjacent to the cartridge-shaped protrusion, a front leg disposed on a distal end of the magazine follower, and a rear leg disposed generally opposite the front leg. In some embodiments, the ammunition round is a 0.223 inch round. In some embodiments, the ammunition round is a 5.56 mm round. In some embodiments, the magazine follower further comprises a tail fin configured to slide vertically within a tail recess of the magazine housing. In some embodiments, the ramp is configured to enable a cartridge to be fed from the ammunition magazine to a chamber of an upper receiver of a firearm without enabling a bullet portion of the cartridge to contact a feed ramp of the upper receiver.

In some embodiments, the present disclosure provides a magazine follower comprising: a cartridge-shaped protrusion on a top surface, a ramp on the top surface and disposed adjacent to the cartridge-shaped protrusion, a front leg disposed on a distal end of the magazine follower, and a rear leg disposed generally opposite the front leg. In some embodiments, the magazine follower further comprises a tail fin disposed adjacent the rear leg and configured to slidably mate with a tail recess of a magazine housing. In some embodiments, the ramp is configured to enable a cartridge to be fed from the ammunition magazine to a chamber of an upper receiver of a firearm without enabling a bullet portion of the cartridge to contact a feed ramp of the upper receiver.

In some embodiments, the present disclosure provides an ammunition magazine comprising a magazine follower configured to orient all ammunition cartridges housed therewithin at an angle of about 0.2° to about 5° relative to a longitudinal axis of an associated chamber. In some embodiments, the angle is about 1.5°. In some embodiments, the magazine follower does not contact a bullet portion of the ammunition cartridges. In some embodiments, a bullet portion of the ammunition cartridges do not contact a feed ramp proximate to the associated chamber. In some embodiments, the follower includes a ramp on its top surface, and wherein the ramp is configured to orient a first ammunition cartridge housed within the ammunition magazine at an angle of about 2° to about 20° relative to the top surface.

In some embodiments, the present disclosure provides a magazine follower configured to orient a first ammunition cartridge housed within an associated ammunition magazine at an angle of about 0.2° to about 5° relative to a top surface of the magazine follower. In some embodiments, the magazine follower comprises a ramp on its top surface, wherein the ramp is configured to orient the first ammunition cartridge housed within the associated ammunition magazine at an angle of about 0.2° to about 5° relative to the top surface. In some embodiments, the follower is configured to not contact a bullet portion of the ammunition cartridge. In some embodiments, the ramp includes a concave top surface and/or a groove oriented along its longitudinal length.

In some embodiments, the ammunition cartridge is a shouldered cartridge. In some embodiments, the ammunition cartridge is a 0.223 cartridge, a 5.7×30 cartridge, a 5.56 cartridge.

In some embodiments, the present disclosure provides a single stack magazine comprising a magazine housing base including a left-hand feed ramp insert, a left-hand feed lip insert including a plurality of tabs, and a plurality of key seat slotted pockets configured to slidably mate with the tabs of the left-hand feed lip insert; a removable plate including a right-hand feed ramp insert, a right-hand feed lip insert including a plurality of tabs, and a plurality of key seat slotted pockets to slidably mate with the tabs of the right-hand feed lip insert; a magazine spring disposed within a magazine housing defined by the magazine housing base and the removable plate; and a magazine follower disposed at a top end of the magazine spring. In some embodiments, the base includes key seat slotted pockets to accept corresponding tabs of a left-hand feed lip insert allowing up and down movement of the left-hand feed lip insert. In some embodiments, the left-hand feed lip comprises an elastic material. In some embodiments, the key seat slotted pockets are configured to cooperate with the tabs of the right-hand feed lip insert to enable up-and-down movement of the right-hand feed lip insert within the magazine housing. In some embodiments, the right-hand feed lip insert comprise an elastic material. In some embodiments, the magazine is configured to enable top-loading of an ammunition cartridge into the magazine housing. In some embodiments, the magazine follower comprises a top surface including a cartridge-shaped protrusion and a ramp disposed adjacent to the cartridge-shaped protrusion. In some embodiments, the cartridge has a common bottle-neck design including a shoulder. In some embodiments, the left-hand feed ramp insert and the right-hand feed ramp insert each contact a shoulder of an ammunition cartridge to guide the cartridge into a chamber without enabling a bullet portion of the cartridge to contact an inner surface of the chamber.

In some embodiments, the present disclosure provides a double stack ammunition magazine comprising a magazine housing base having an integrated left-hand feed ramp; a removable magazine box plate having an integrated right-hand ramp insert; a magazine spring disposed within a magazine housing defined by the magazine housing base and the removable magazine box plate; and a magazine follower disposed at a top end of the magazine spring. In some embodiments, the right-hand ramp inserts and the left-hand ramp inserts are each configured to guide a cartridge including a bullet portion from the magazine housing into a barrel extension without the bullet portion contacting an interior surface of the barrel extension. In some embodiments, the right-hand feed ramp insert and the left-hand feed ramp insert each contact a shoulder of the cartridge to guide the cartridge into a chamber without enabling a bullet portion of the cartridge to contact an inner surface of the chamber. In some embodiments, the barrel extension includes a right-hand loading slot and a left-hand loading slot configured to guide a cartridge from the magazine into a chamber. In some embodiments, the left-hand feed ramp insert is configured to contact a shoulder of a cartridge, but not a bullet portion of the cartridge, upon the cartridge being advanced towards the barrel extension by a bolt. In some embodiments, the right-hand feed ramp insert is configured to contact a shoulder of a cartridge, but not a bullet portion of the cartridge, upon the cartridge being advanced towards the barrel extension by a bolt. In some embodiments, the cartridge has a common bottle-neck design including a shoulder.

While the present disclosure has been shown and described herein by illustrating the results and advantages over the prior art, the disclosure is not limited to those specific embodiments. Thus, the forms of the disclosure shown and described herein are to be taken as illustrative only and other embodiments may be selected by one having ordinary skill in the art without departing from the scope of the present invention.

What is claimed is:

1. An ammunition magazine configured to bottom-feed a plurality of ammunition cartridges into an upper receiver of a firearm, each ammunition cartridge comprising a bullet, the ammunition magazine comprising:

a magazine housing including a catch and a floor plate receiver;

a spring within the magazine housing;

a floor plate retainer disposed at a bottom end of the spring;

a floor plate disposed at a bottom end of the magazine housing and reversibly mated with the floor plate retainer; and a magazine follower disposed at a top end of the spring, the magazine follower including:

a cartridge-shaped protrusion on a top surface, a ramp on the top surface and disposed adjacent to the cartridge-shaped protrusion, and configured to direct a cartridge from the ammunition magazine to an upper receiver portion of an associated firearm without enabling contact between any portion of the bullet of the ammunition cartridge and a feed ramp portion of the receiver, a front leg disposed on a distal end of the magazine follower, and a rear leg disposed generally opposite the front leg.

2. The ammunition magazine of claim 1, wherein the ammunition round is a 0.223 inch round.

3. The ammunition magazine of claim 1, wherein the ammunition round is a 5.56 mm round.

4. The ammunition magazine of claim 1, wherein the magazine follower further comprises a tail fin configured to slide vertically within a tail recess of the magazine housing.

5. A magazine follower comprising:

a cartridge-shaped protrusion on a top surface, a ramp on the top surface and disposed adjacent to the cartridge-shaped protrusion, and configured to direct a cartridge comprising a bullet from an ammunition magazine to an upper receiver portion of an associated firearm without enabling contact between the bullet of the cartridge and a feed ramp portion of the receiver, a front leg disposed on a distal end of the magazine follower, and a rear leg disposed generally opposite the front leg.

6. The magazine follower of claim 5 further comprising a tail fin disposed adjacent the rear leg and configured to slidably mate with a tail recess of a magazine housing.

7. The ammunition magazine of claim 5, wherein the ammunition cartridge is a 0.223 cartridge or a 5.56 cartridge.

8. An ammunition magazine configured to mate with an upper receiver of an associated firearm, the ammunition magazine comprising:

a cavity;

a magazine follower disposed in the cavity and comprising:

a top surface, and a ramp on the top surface configured to align a cartridge comprising a bullet from the ammunition magazine with a chamber of the upper receiver of the associated firearm such that the bullet of the cartridge will not contact a feed ramp of the upper receiver; and a compression spring disposed to exert an upward force on the magazine follower.

9. The ammunition magazine of claim 8, wherein the ammunition round is a 0.223 inch round.

10. The ammunition magazine of claim 8, wherein the ammunition round is a 5.56 mm round.

11. The ammunition magazine of claim 8, wherein the magazine follower further comprises a tail fin configured to slide vertically within a tail recess of the ammunition magazine.

* * * * *